US008210161B2

(12) United States Patent
Mattos

(10) Patent No.: US 8,210,161 B2
(45) Date of Patent: Jul. 3, 2012

(54) COMPRESSED GAS POWERED PROJECTILE GUN

(76) Inventor: Robert Mattos, Potomac Falls, VA (US)

( * ) Notice: Subject to any disclaimer, the term of this patent is extended or adjusted under 35 U.S.C. 154(b) by 247 days.

(21) Appl. No.: 12/782,336

(22) Filed: May 18, 2010

(65) Prior Publication Data

US 2010/0288256 A1 Nov. 18, 2010

Related U.S. Application Data

(60) Provisional application No. 61/179,038, filed on May 18, 2009.

(51) Int. Cl.
*F41B 11/00* (2006.01)

(52) U.S. Cl. ..... 124/74

(58) Field of Classification Search ..... 124/73–74
See application file for complete search history.

(56) References Cited

U.S. PATENT DOCUMENTS

| | | | | | |
|---|---|---|---|---|---|
| 2,839,862 | A | * | 6/1958 | Hanshaw | 43/6 |
| 2,861,560 | A | * | 11/1958 | Alinari | 124/69 |
| 2,923,089 | A | * | 2/1960 | Fissel | 446/231 |
| 2,957,468 | A | * | 10/1960 | Enfield | 124/57 |
| 3,139,692 | A | * | 7/1964 | Sellers et al. | 42/1.14 |
| 3,320,941 | A | * | 5/1967 | Houghton | 124/67 |
| 3,780,720 | A | * | 12/1973 | Alderson | 124/74 |
| 3,859,977 | A | * | 1/1975 | Lange | 124/66 |
| 4,110,929 | A | * | 9/1978 | Weigand | 43/19 |
| 4,890,597 | A | | 1/1990 | Ekstrom | |
| 5,086,749 | A | | 2/1992 | Ekstrom | |
| 5,161,516 | A | | 11/1992 | Ekstrom | |
| 5,242,323 | A | * | 9/1993 | Rappaport | 446/180 |
| 5,343,850 | A | * | 9/1994 | Steer | 124/64 |
| 5,522,374 | A | * | 6/1996 | Clayton | 124/59 |
| 5,975,068 | A | * | 11/1999 | Halter et al. | 124/63 |
| 6,048,280 | A | * | 4/2000 | Palmer et al. | 473/416 |
| 7,287,526 | B1 | * | 10/2007 | Bligh et al. | 124/63 |

FOREIGN PATENT DOCUMENTS

WO 2005/069929 8/2005

* cited by examiner

*Primary Examiner* — Troy Chambers
(74) *Attorney, Agent, or Firm* — Nixon & Vanderhye P.C.

(57) ABSTRACT

A compressed gas gun fires arrows or other similar projectiles. A compressed gas delivery mechanism within the compressed gas gun ensures that a predetermined amount of compressed gas is used to fire an arrow during a firing operation. Various elements within the compressed gas gun can be selectively tailored to provide greater or lesser amounts of compressed gas during each firing operation.

20 Claims, 8 Drawing Sheets

COMPRESSED GAS POWERED PROJECTILE GUN

CROSS-REFERENCES TO RELATED APPLICATIONS

This application claims priority to the filing date of U.S. Provisional Application Ser. No. 61/179,038, filed May 18, 2009, the entire contents of which are hereby incorporated by reference.

BACKGROUND OF THE INVENTION

The invention relates to a gun which can fire a projectile such as an arrow using compressed gas.

Prior attempts to create a gun which can fire an arrow using compressed gas have not resulted in a gun which can control the amount of compressed gas which is used to fire the arrow. For instance, in the device illustrated in U.S. Pat. Nos. 4,890,597 and 5,086,749, the device does not deliver a precisely measured amount of compressed gas to fire an arrow. In addition, in the device illustrated in the above-listed patents, there was no way to securely hold an arrow on the gun. Further, there is no type of safety mechanism to prevent an accidental firing of the gun.

BRIEF DESCRIPTION OF THE DRAWINGS

FIGS. 5A and 5B are front and top views of a spring nut;

DETAILED DESCRIPTION OF PREFERRED EMBODIMENTS

Figure 1:
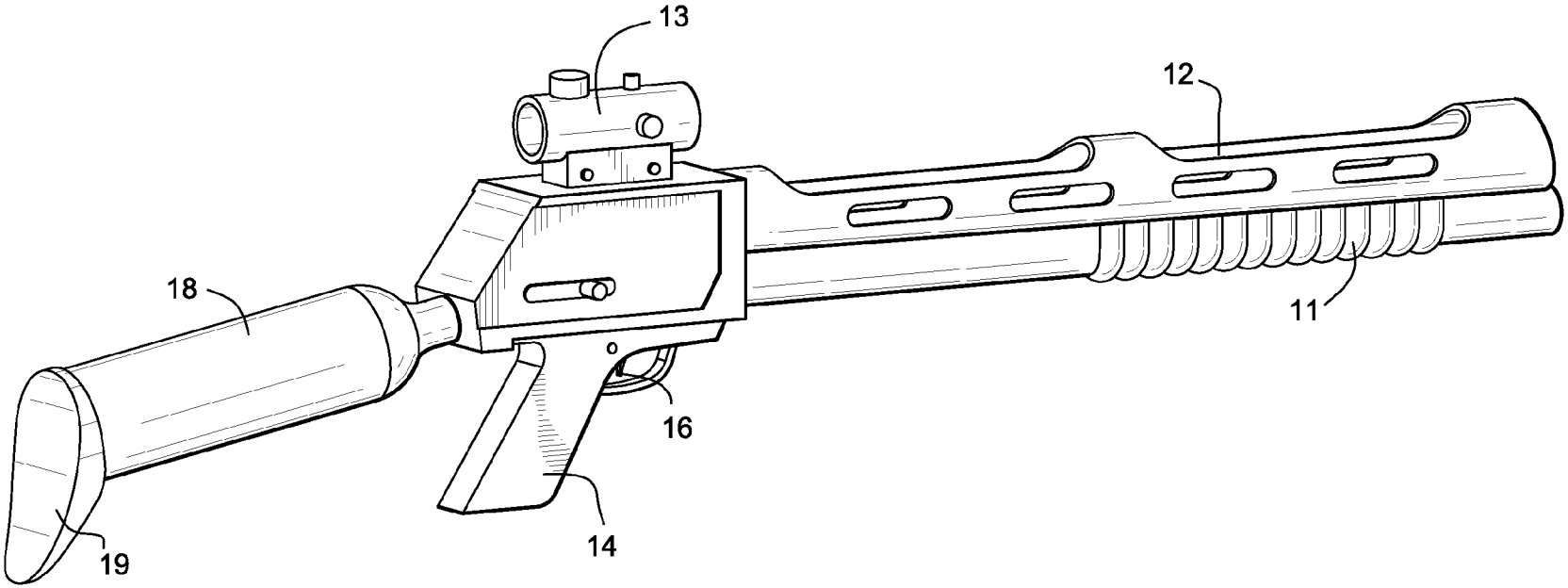
FIG. 1 is a diagram of a first embodiment of a compressed gas gun which can fire an arrow.

FIG. 1 illustrates a first embodiment of a compressed gas gun capable of firing an arrow. The gun includes a pistol grip type handle 14 with a trigger 16. A compressed gas bottle 18 projects rearward from the pistol grip handle 14. A shoulder rest 19 may be attached to the rear of the compressed gas bottle 18. The gun also includes a sighting mechanism 13 and a hand grip 11 formed on the bottom of an arrow shield 12.

Figure 2:
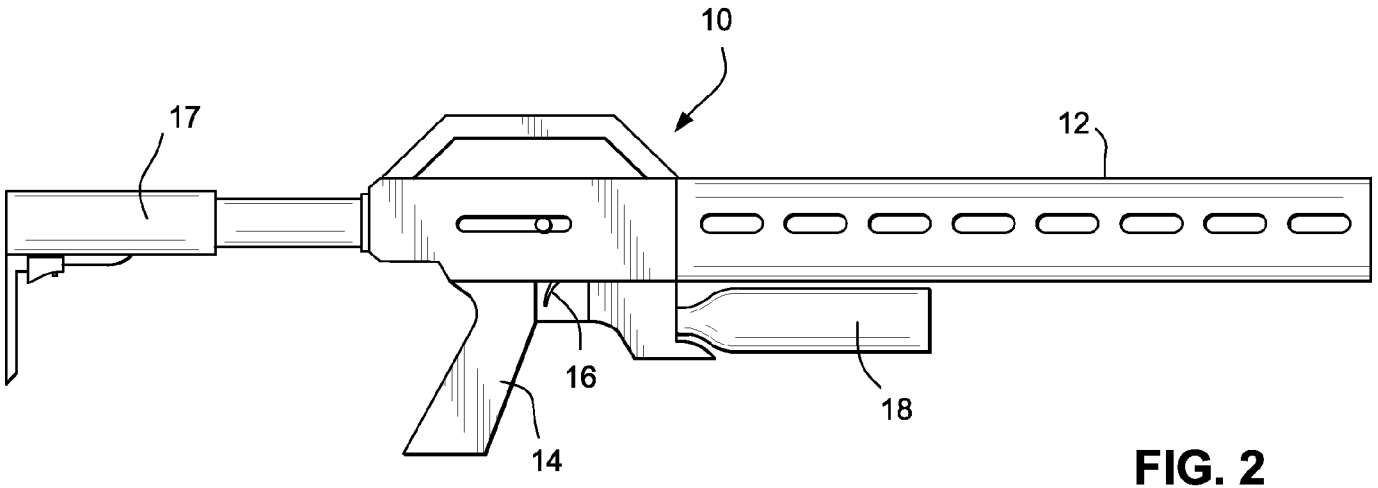
FIG. 2 is a diagram of a second embodiment of a compressed gas gun which can fire an arrow.

An alternate embodiment of the compressed gas gun is illustrated in FIG. 2. In this embodiment, the compressed gas bottle 18 is located under the arrow shield 12. This embodiment also includes a shoulder stock 17 that projects rearward from the pistol grip handle 14. In some embodiments, the length and the position of the shoulder stock 17 can be adjustable to customize the gun to an individual user.

In operation, an arrow would be inserted into a mechanism within the arrow shield 12, the gun would be cocked, and the trigger 16 would be pulled to fire the arrow. During a firing operation, a predetermined amount of compressed gas would be used to fire the arrow out of the arrow shield 12 of the gun.

Figure 3:
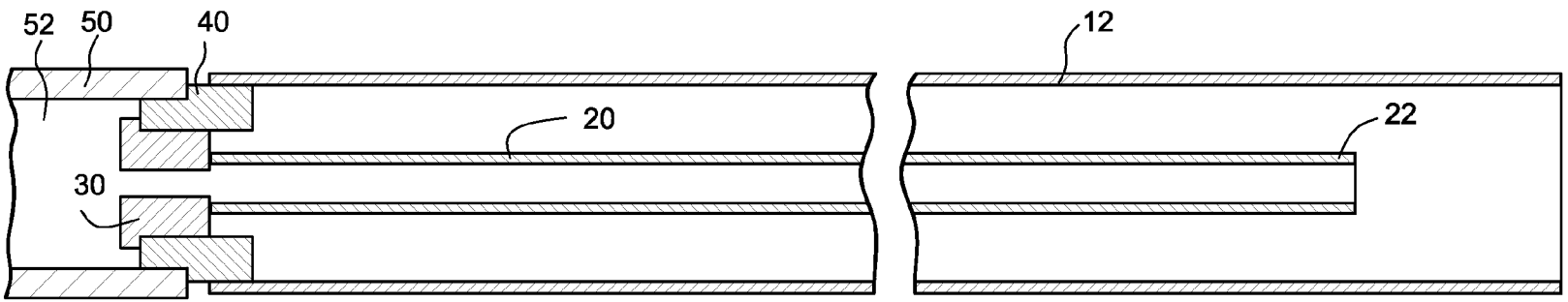
FIG. 3 is a cross-sectional view of a portion of a compressed gas gun which receives an arrow.

A cross-sectional view showing the interior elements of the arrow guide portion is provided in FIG. 3. As shown in FIG. 3, a compressed gas delivery tube 20 is located inside the arrow shield 12. The compressed gas delivery tube 20 extends forward from a barrel nut 30. The barrel nut 30 is mounted on a collar 40. The arrow shield 12 projects forward from the collar 40. In addition, an action housing 50 projects rearward from the collar 40.

Figure 4:
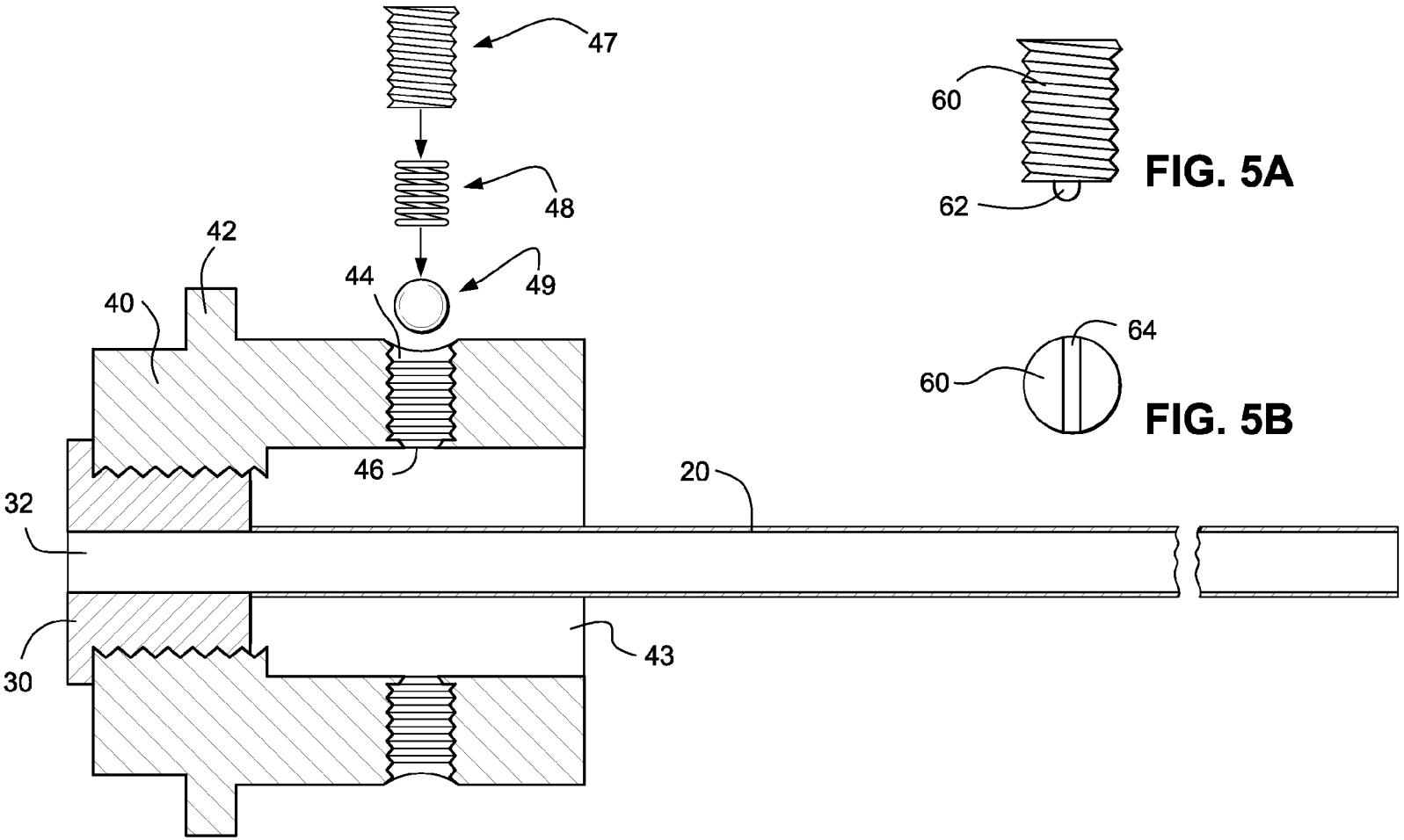
FIG. 4 is a cross-sectional view of a portion of a compressed gas gun which receives the nock of an arrow.

A more detailed view of the elements of the collar 40 is provided in FIG. 4. As shown in FIG. 4, the collar 40 includes a collar seating ridge 42. The action housing 50 rests against the rear side of the collar seating ridge 42. In addition, the arrow shield 12 projects forward from the collar seating ridge 42.

The barrel nut 30 includes exterior screw threads which allow it to be screwed into an interior threaded passage through the collar 40. In some embodiments, the barrel nut 30 would be attached to the gas delivery tube 20. In this instance, the gas delivery tube 20 would be mounted on the collar 40 by screwing the barrel nut 30 into the central threaded aperture of the collar 40. In alternate embodiments, the gas delivery tube 20 may be mounted on the mechanism in some other fashion.

FIG. 4 also illustrates that a gas passageway 32 is formed through the center of the barrel nut 30. This allows compressed gas located on a rear side of the barrel nut 30 to pass through the gas passageway 32 and then down into the compressed gas delivery tube 20.

An arrow nock aperture 43 surrounds the rear end of the compressed gas delivery tube 20. When an arrow is loaded into the compressed gas gun, a hollow shaft of the arrow would surround the exterior of the compressed gas delivery tube 20. The nock at the rear end of the arrow would be positioned within the arrow nock aperture 43 of the collar 40.

The collar also includes a plurality of threaded radially extending passages 44. A small circular opening 46 is located at the interior end of each of the threaded radial passages 44. The diameter of the opening 46 is slightly smaller that a diameter of balls 49 which are inserted into the threaded radial passages 44.

Each ball 49 would be inserted into the bottom of a threaded radial passage 44 such that a portion of the ball 49 extends through the opening 46 and down into the arrow nock aperture 43 of the collar 40. A spring 48 would then be inserted behind the ball 49. Finally, a set screw 47 would be screwed down into the threaded radial passage 44. As a result, the ball would be biased into the arrow nock aperture. However, the ball could move in the outward radial direction against the biasing force of the spring 48.

In alternate embodiments, the ball 49, spring 48 and set screw 47 could be replaced with a spring nut 60 as illustrated in FIGS. 5A and 5B. The spring nut 60 would include a cylindrical body with exterior screw threads. A spring mounted ball is located at one end of the spring nut 60. The ball 62 is spring biased in the main body of the spring nut. As a result, it is possible to push the ball into the interior of the spring nut body. As illustrated in FIG. 5B, a slot 64 is formed on the top end of the spring nut 60 so that the spring nut 60 can be screwed into one of the threaded radially passages 44 of the collar 40.

Figure 6:
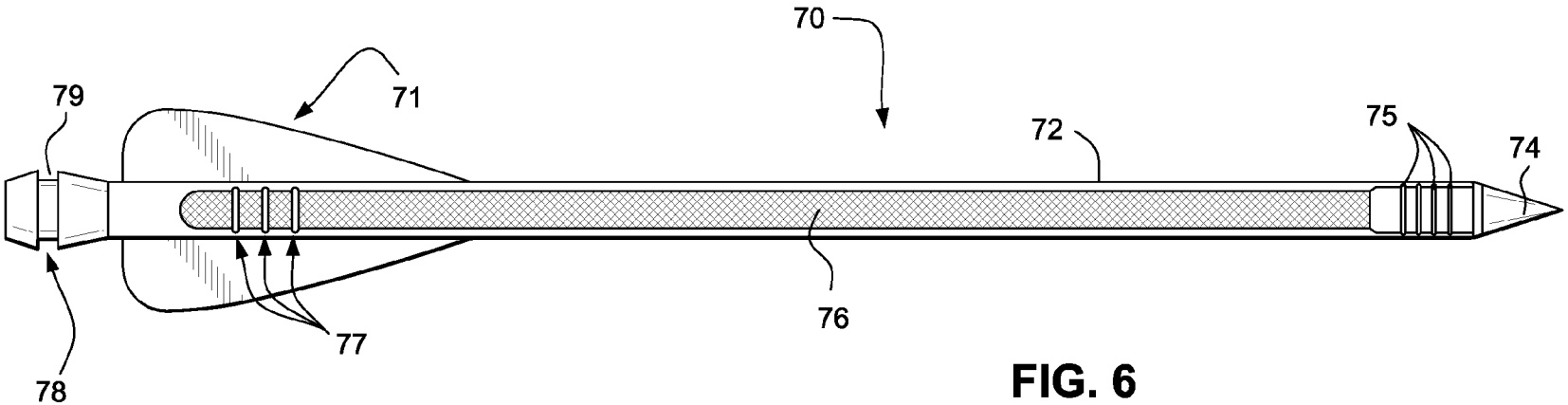
FIG. 6 is a cross-sectional view of an arrow which could be used in a compressed gas gun embodying the invention.

FIG. 6 illustrates a typical arrow which could be used with a compressed gas gun embodying the invention. The arrow includes an exterior shaft 72. A tip 74 is attached to the forward end of the shaft 72. The tip 75 may include one or more o-ring seals to provide a gas tight connection between the interior of the shaft 72 and the tip 74. The tip 74 could be attached to the forward end of the shaft 72 in any conventional manner, including through the use of screw threads.

Fletching 71 is located at the rear end of the shaft 72. In addition, a nock 78 is attached to the rear end of the shaft 72. The nock 78 includes a groove 79. In the embodiment illustrated in FIG. 6, the groove is a circumferential groove. However, in alternate embodiments, the groove can be configured in different ways. Also, instead of a groove, one or more depressions could be formed on the rear end of the shaft, or on a separate nock element that is attached to the rear end of the shaft.

Figure 7:
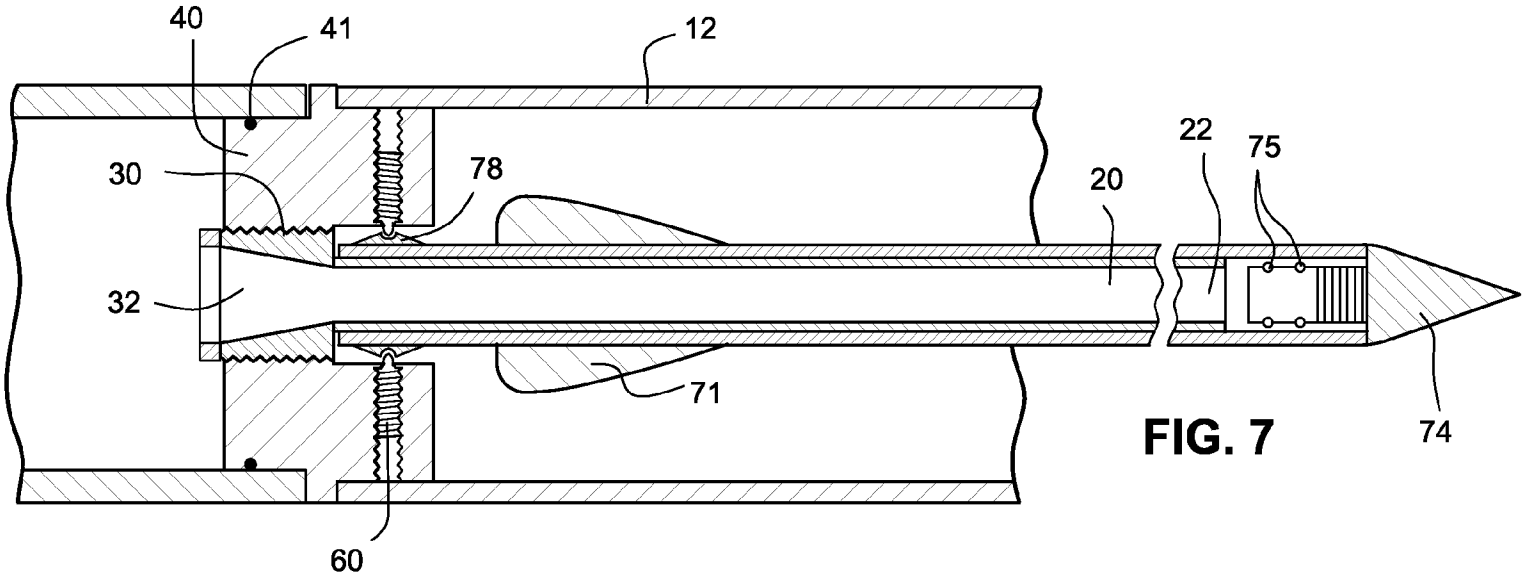
FIG. 7 is a cross-sectional view illustrating how an arrow would be mounted in the arrow receiving portion of a compressed gas gun.

FIG. 7 shows how an arrow as illustrated in FIG. 6 would be mounted over the compressed gas delivery tube 20 of a compressed gas gun embodying the invention. As shown in FIG. 7, the shaft of the arrow would be fitted over the exterior of the compressed gas delivery tube 20, and the arrow would be slid rearward into the arrow shield 12 of the compressed gas gun. When the arrow is pressed fully into the gun, the nock 78 at the rear of the shaft 72 of the arrow would enter the arrow nock aperture 43 in the collar 40. The balls 49, or the balls 62 of a spring nut 60, would ride along the exterior of the nock 78 as the arrow is inserted until the balls fall into the annular groove 79 in the nock 78. Because the balls 49/62 are spring loaded, the balls would latch onto the nock of the arrow.

As noted above, an alternate set of elements could hold the arrow in place within the gun. For instance, spring loaded fingers located on the gun could grasp individual depressions or apertures on the rear of the arrow shaft, or on a nock element mounted at the rear of the shaft. Also, instead of spring loading the elements that hold the arrow, the elements on the gun that engage and hold the shaft may be controlled by a completely separate mechanism that releases the arrow at an appropriate time.

Also, because the compressed gas delivery tube 20 is located in the interior of the arrow shaft 72, the arrow would be centered within the arrow shield 12 so that the fletching 71 is not resting against the interior surfaces of the arrow shield 12. As also illustrated in FIG. 7, the tip end 22 of the compressed gas delivery tube would be located at the forward end of the arrow, adjacent the tip 74 of the arrow.

In some embodiments, the arrow 70 might also include an interior shaft 76 which extends down the center of the interior of the shaft 72. The interior shaft 76 may be connected to the tip 74. If such an interior shaft 76 is provided, one or more o-ring seals 77 may be provided at the rear end of the interior shaft 76. The o-ring seals 77 would form a seal against the interior of the compressed gas delivery tube.

As explained above, during a firing operation, a predetermined amount of compressed gas would be delivered into the interior of the compressed gas delivery tube 20. As a result, the compressed gas would force the arrow 70 out of the front end of the compressed gas gun. The compressed gas delivery tube 20 would also act as a guide to guide the forward movement of the arrow as it leaves the compressed gas gun.

During a firing operation, the nock holding mechanism holds the arrow in position as pressure begins to build within the compressed gas delivery tube. The spring force pressing the balls 49/62 into the groove 79 of the arrow nock is configured to provide a certain amount of holding force. The arrow will not begin to move until the force of the compressed gas within the arrow shaft overcomes the nock holding force. This allows pressure to build to a certain level before the arrow is released, which helps to ensure the arrow is fired with a sufficient amount of force.

The user may be able to vary the spring force that presses the balls 49/62 into the groove 79, such as by screwing the set screw 47 or the spring nut 60 to different depths within the threaded radial passages 44 within the collar 40. Alternatively, various different springs 48 or spring nuts 60 having different spring rates could be provided to a user, and the user could install the desired springs/spring nuts to obtain a desired holding force. This would allow the user to vary the holding force, and thus the point at which the arrow is released as the pressure builds within the compressed gas delivery tube.

As noted above, elements other than spring loaded balls or fingers could hold a groove or depressions or apertures on the arrow to hold the arrow in place until a sufficient amount of gas pressure has built up within the compressed gas delivery tube. Such an alternate holding and releasing mechanism might, for instance, be actuated based on the compressed gas pressure within the compressed gas delivery tube. Thus, the mechanism might be triggered to release the arrow when the pressure within the compressed gas delivery tube has reached a certain predetermined level. Also, the level at which the mechanism is triggered to release the arrow might be controllable by the user so that the arrow is released at a selectable pressure.

In still other alternate embodiments, spring loaded balls for fingers or projections on the arrow itself might seat into grooves or depressions on the gun. And the engagement between the balls or fingers on the arrow and the grooves or depressions on the gun may act to hold and then release the arrow. Thus, the positions of the holding and releasing elements as shown in FIGS. 4-7 may be reversed in alternate embodiments.

Also, the embodiments illustrated in FIGS. 4-7 show the holding and releasing elements being located at a rear of the arrow. In alternate embodiments, the holding and releasing elements may be located at any position along the length of the arrow. For instance, the holding and releasing elements may act upon the tip of the arrow.

A description of a compressed gas delivery mechanism for delivering a predetermined amount of compressed gas down into the compressed gas delivery tube 20 will now be provided with reference to FIGS. 8-14

Figure 8:
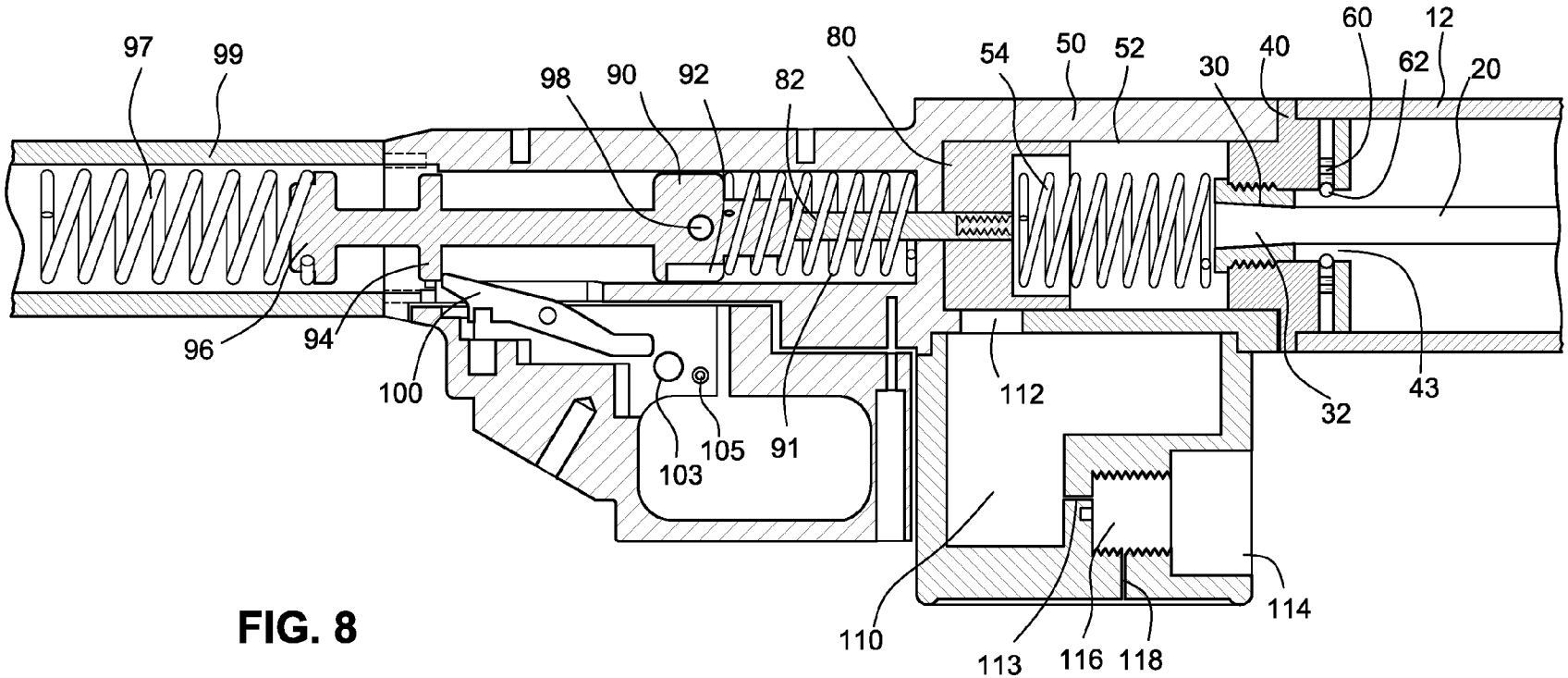
FIG. 8 is a cross-sectional view of a compressed gas delivery mechanism of a compressed gas gun in a first operational condition.

As illustrated in FIG. 8, the action housing 50 is attached to the rear end of the collar 40. A cylindrical compressed gas chamber 52 is located immediately behind the collar 40. Compressed gas within the compressed gas chamber 52 can pass down the internal passageway 32 of the barrel nut 30 and then into the compressed gas delivery tube 20.

A piston 80 is movably mounted within the compressed gas chamber 52. A piston stem 82 extends rearward from the main body of the piston 80. In addition, a biasing element in the form of a spring 54 biases the piston 54 toward the rear of the compressed gas chamber 52, as illustrated in FIG. 8. The rearward-most position will be referred to as a resting position.

A movably mounted hammer 90 is located to the rear of the piston and piston stem 82. The hammer 90 includes a handle 98 which would protrude out of the action housing. The handle 98 would allow a user to pull the hammer rearward into a cocked position.

A compressed gas inlet 112 is formed on the bottom of the cylindrical compressed gas chamber 52. The compressed gas inlet 112 allows compressed gas to enter the compressed gas chamber 52.

Immediately below the compressed gas inlet 112 is a compressed gas accumulation chamber 110. During a firing operation, compressed gas located within the compressed gas accumulation chamber 110 will flow through the compressed gas inlet 112 into the compressed gas chamber 52, and then out of the compressed gas chamber 52 through the compressed gas delivery tube 20.

A compressed gas bottle would be mounted to the forward side of the compressed gas accumulation chamber 110. A threaded neck of the compressed gas bottle would be screwed into a threaded bore 116, and the bottle neck would be located within a bottle neck aperture 114. A compressed gas inlet 113 would allow compressed gas from a compressed gas bottle to enter the compressed gas accumulation chamber 110.

During a mounting operation, as a compressed gas bottle is screwed into the threaded bore 116, a projection within the threaded bore would press upon a spring loaded valve on the compressed gas bottle, or the projection would pierce the cover member of the compressed gas bottle. As a result, compressed gas from within the bottle would be allowed to travel through the compressed gas inlet 113 into the compressed gas accumulation chamber 110.

During a dismounting operation, as a compressed gas bottle is unscrewed from the threaded bore 116, any compressed gas located in the compressed gas accumulation chamber 110 would be allowed to vent through the compressed gas inlet 113 and a pressure relief channel 118 before the compressed gas bottle is fully unscrewed from the threaded bore 116. This would prevent pressure within the compressed gas accumulation chamber 110 from forcibly expelling the compressed gas bottle during a dismounting operation.

Although the above description assumes that the compressed gas bottle will be located in a generally horizontal orientation under the arrow shield, as illustrated in the embodiment shown in FIG. 2, in alternate embodiments the gas bottle could be mounted in different orientations.

FIG. 8 illustrates the piston 80 located at the resting position at the rear of the compressed gas chamber 52. When the piston 80 is located at the resting position, the piston 80 will prevent compressed gas in the compressed gas accumulation chamber 110 from traveling through the compressed gas inlet 112 into the compressed gas chamber 52.

Figure 11B:
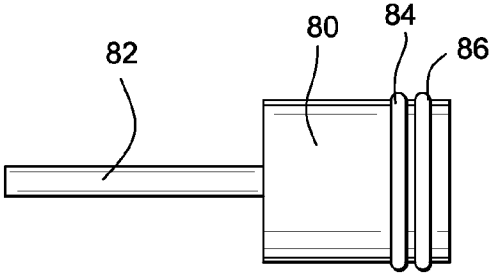
FIG. 11B is a side view of the piston of FIG. 11A.
Figure 11A:
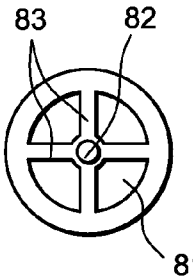
FIG. 11A is a front view of a piston of a compressed gas delivery mechanism.

A first embodiment of the piston 80 is illustrated in FIGS. 11A and 11B. As shown in FIG. 11B, the piston 80 includes a main cylindrical body and a piston stem 82. As illustrated in FIG. 11A, the piston stem is attached to cross spokes 83. However, the remaining portions of the interior of the piston 80 are hollow. This includes piston apertures 81 formed between the cross spokes 83. As a result, gas can pass through the interior of the piston.

In the embodiment illustrated in FIG. 11B, two o-rings 84, 86 are located in annular grooves at a forward end of the exterior cylindrical body. However, in alternate embodiment, only a single o-ring seal may be provided, or additional o-ring seals may be provided.

Figure 12:
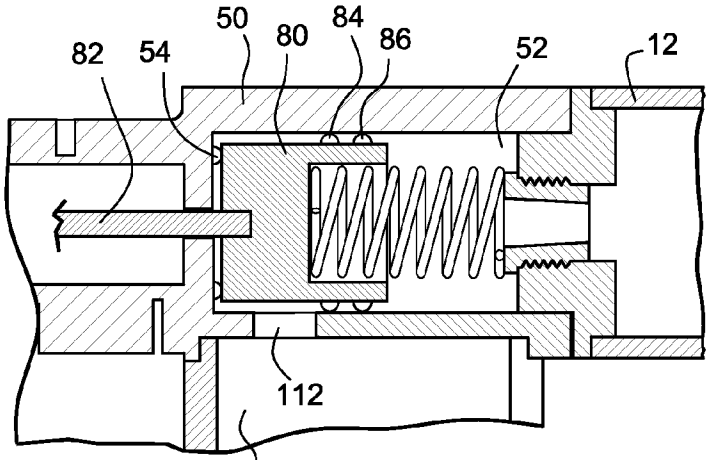
FIG. 12 is a sectional view illustrating the piston of FIGS. 11A and 11B mounted within a compressed gas delivery mechanism.

A piston as illustrated in FIGS. 11A and 11B is illustrated within a compressed gas delivery mechanism of a compressed gas gun in FIG. 12. In the embodiment illustrated in FIG. 12, a rear seal 54 is located at a rear end of the compressed gas chamber 52. When the piston 80 is located at the resting position at the rear of the compressed gas chamber 52, the cylindrical rear surface of the piston 80 abuts the rear seal 54 to provide a gas-tight connection. In addition, the two o-ring seals 84 and 86 form a gas tight connection between the exterior cylindrical surface of the piston 80 and the interior cylindrical surface of the compressed gas chamber 52. As a result of the rear seal 54 and the o-rings 84/86, any compressed gas in the compressed gas accumulation chamber 110 cannot pass the seals into the interior of the compressed gas chamber 52.

Figure 13B:
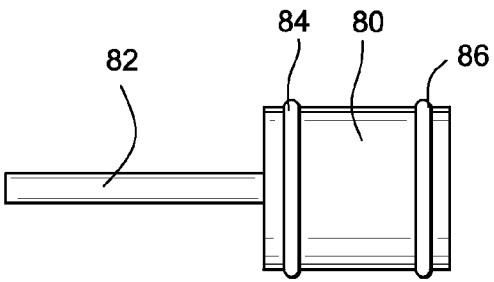
FIG. 13B is a side view of the piston illustrated in FIG. 13A.
Figure 13A:
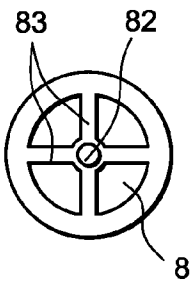
FIG. 13A is a front view of a second embodiment of a piston of a compressed gas delivery mechanism.

An alternate embodiment of the piston 80 is illustrated in FIGS. 13A and 13B. In this embodiment, a first o-ring seal 85 is located at a rear end of the cylindrical surface of the piston. A second forward o-ring seal 86 is located at the forward end of the exterior cylindrical surface of the piston 80.

Figure 14:
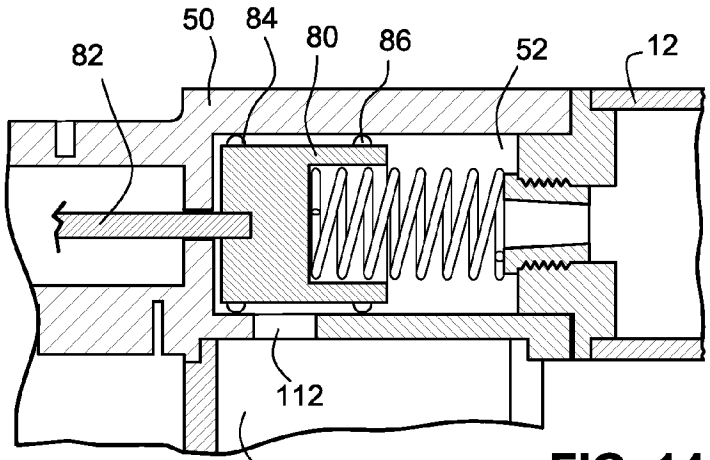
FIG. 14 is a cross sectional view showing the piston of FIGS. 13A and 13B in a compressed gas delivery mechanism.

A piston as illustrated in FIGS. 13A and 13B mounted within a compressed gas delivery mechanism is shown in FIG. 14. As shown in FIG. 14, the rear o-ring seal 85 forms the seal between the exterior cylindrical surface of the piston 80 and the interior cylindrical surface of the compressed gas chamber 52. In addition, the forward o-ring seal 86 provides a seal between the exterior cylindrical surface of the piston 80 and the interior cylindrical surface of the compressed gas chamber 52. Thus, the two o-ring seals prevent any compressed gas located in the compressed gas accumulation chamber 110 from passing into the interior compressed gas chamber 52.

Figure 9:
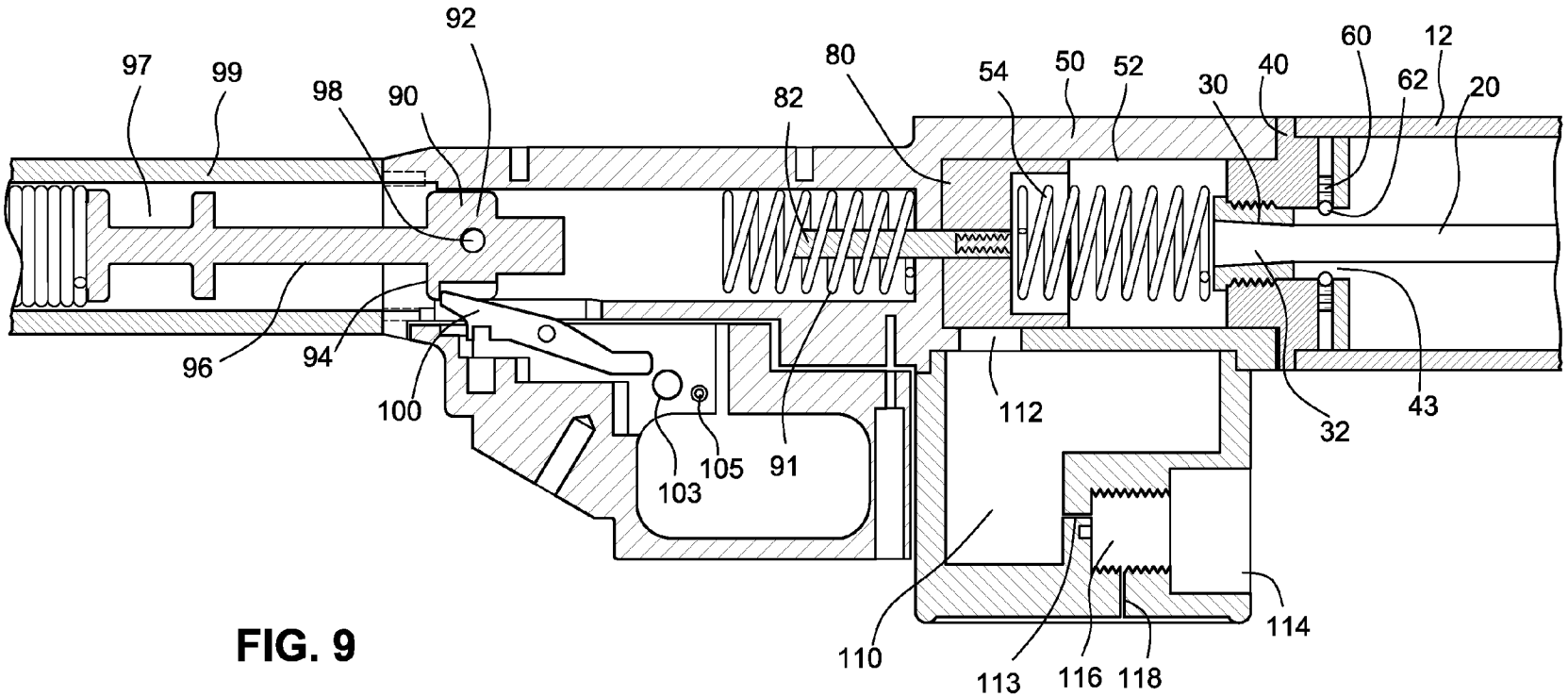
FIG. 9 is a cross-sectional view of the compressed gas delivery mechanism of FIG. 8 in a second operational condition.
Figure 10:
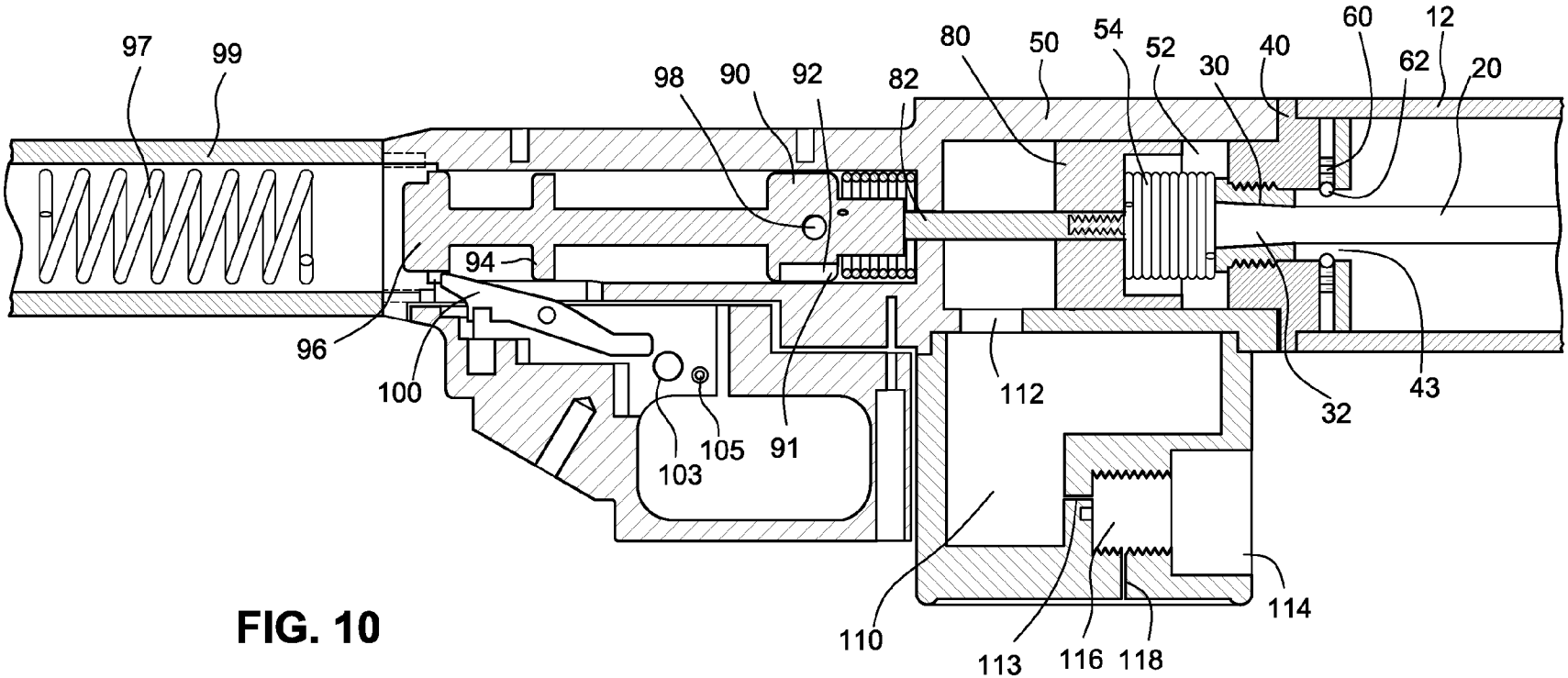
FIG. 10 is a cross-sectional view of the compressed gas delivery mechanism of FIG. 8 in a third operational condition.

A description of how the mechanism delivers a predetermined amount of compressed gas into the compressed gas delivery tube 20 will now be provided with reference to FIGS. 8-10.

FIG. 8 shows the piston 80 at the resting position at the rear of the compressed gas chamber 52. In the absence of other forces, the piston spring 54 keeps the piston 80 located at the rear of the compressed gas chamber 52. As explained above, sealing elements attached to the piston 80 prevent compressed gas in the compressed gas accumulation chamber 110 from passing into the compressed gas chamber 52 and then on to the compressed gas delivery tube 20.

FIG. 9 illustrates the mechanism in a cocked position. In this position, the hammer 90 has been pulled rearward until a safety and trigger latch element 100 rests against a latch receptacle 92 formed on the hammer 90. Pulling the hammer 90 rearward also compresses a hammer spring 97 which is located behind the rear end 96 of the hammer 90.

When a user pulls the trigger of the compressed gas gun, the rear end of the safety and trigger latch 100 is moved downward, which frees the hammer to move forward. The hammer spring 97 pushes the hammer 90 in the forward direction until it strikes against the piston stem 82. The inertia of the hammer 90, along with the force of the hammer spring 97, forces the piston 80 to move in the forward direction into a position as illustrated in FIG. 10.

When the piston 80 moves to the forward position illustrated in FIG. 10, the seals which normally prevent compressed gas from moving from the compressed gas accumulation chamber 110 into the compressed gas chamber 52 are opened. As a result, compressed gas stored in the compressed gas accumulation chamber 110 is allowed to move through the compressed gas inlet 112 into the compressed gas chamber 52. Because the piston 80 is hollow, compressed gas on the rear side of the piston 80 can pass directly through the piston and then down into the compressed gas delivery tube 20. As explained above, this compressed gas is used to fire an arrow from the forward end of the gun.

When the mechanism is in the position shown in FIG. 10, the force provided by the piston spring 54 is greater than the force provided by the hammer spring 97. As a result, once forward motion of the hammer 90 has ceased, the piston spring 54 will push the piston 80 backward into the position illustrated in FIG. 8. As a result, the seals on the piston will again prevent gas from the compressed gas accumulation chamber 110 from entering the compressed gas chamber 52.

In addition, a return spring 91 may be located on the forward side of the hammer 90. Once forward movement of the hammer 90 has been halted by the safety and trigger latch 100, the return spring 91 may assist in pushing the hammer back to the position illustrated in FIG. 8. This would also make it easier for the piston spring 54 to return the piston 80 to the resting position illustrated in FIG. 8. The use of the return spring 91, however, is optional.

Once the piston 80 has returned to the resting position, and the seals block compressed gas from entering the compressed gas chamber 52, gas from within the gas bottle will move through the compressed gas inlet 113 to again fill the compressed gas accumulation chamber, thereby readying the gun for another firing operation.

FIG. 8 also illustrates that the safety and trigger latch 100 will come to rest against a safety ridge 94 on the hammer 90. The engagement between the safety and trigger latch 100 and the safety ridge 94 helps to ensure that the hammer cannot move forward, and this prevents the gun from being accidentally fired.

As shown in FIG. 8, a trigger pivot hole 105 is located in front of the safety and trigger latch 100. A shaft extending from the trigger, or a shaft about which the trigger rotates, would be mounted in this trigger pivot hole 105.

Also, a safety hole 103 is located between the trigger pivot hole 105 and the safety and trigger latch 100. A safety shaft would be located in the safety hole 103. When in the safe position, the safety shaft would act to prevent the trigger from moving, thereby also preventing an accidental discharge of the gun. When the safety shaft is moved to a firing position, the trigger would be allowed to move to push the front end of the safety and trigger latch 100 upward so that the gun can be fired.

The force provided by the hammer spring 97 can be varied by changing its spring rate. Also, the mass of the hammer 90 can be selectively varied to provide differing amounts of striking force to the piston 80. Further, the force provided by the piston spring 54 can be varied by changing its spring rate. By selectively varying each of the above described elements, one can selectively vary how the mechanism operates to provide varying amounts of compressed gas into the compressed gas delivery tube 20 to fire an arrow.

For instance, if a piston spring 54 with a low spring rate is provided in the gun, the piston will remain at the forward position during a firing operation for a long period of time, and this will result in a great amount of compressed gas being used to fire an arrow. However, if that piston spring were replaced with a stiffer piston spring having a higher spring rate, the piston would be returned to the resting position more quickly. And that would result in a smaller amount of compressed gas being used to fire an arrow.

Similar changes can be made to the mass of the hammer and to the hammer spring 97 to provide similar varying results. Moreover, if a return spring 91 is used, the spring rate of the return spring can also be selectively varied to change the amount of compressed gas which is delivered during each firing operation.

In addition, one can vary the size of the apertures through which the compressed gas travels to vary the amount of compressed gas that is used for a firing operation. For instance, if the compressed gas inlet 112 were made larger, this would increase the amount of compressed gas that is delivered during a firing operation. Of course, if the size of the compressed gas inlet 112 becomes larger, it might also be necessary to lengthen the piston 80 so that the seals on the piston 80 can keep the compressed gas inlet 112 sealed when the piston is in the resting position. Similar changes could be made to the diameter of the piston itself (since the compressed gas travel through the center of the piston), and to the air passage 32 in the barrel nut 30.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims.

The invention claimed is:

1. A gun configured to fire a projectile using compressed gas, comprising:
- an action housing;
- a trigger mounted on the action housing;
- a compressed gas delivery tube that extends from the action housing, wherein a hollow arrow can be fitted around an exterior of the compressed gas delivery tube; and
- a compressed gas delivery mechanism that can be coupled to a compressed gas source, wherein after the compressed gas delivery mechanism has been put into a cocked configuration, the compressed gas delivery mechanism delivers a predetermined amount of compressed gas into the compressed gas delivery tube when a user pulls the trigger.

2. The gun of claim 1, wherein the compressed gas delivery mechanism comprises:
- a cylindrical compressed gas chamber located in the action housing, wherein an gas outlet of the cylindrical compressed gas chamber is operatively coupled to the compressed gas delivery tube;
- a compressed gas accumulation chamber located on the action housing, wherein an outlet of the compressed gas accumulation chamber is operatively connected to an gas inlet of the cylindrical compressed gas chamber;
- a piston that is movably mounted in the cylindrical compressed gas chamber, wherein when the piston is located at a resting position within the cylindrical compressed gas chamber, the piston prevents compressed gas in the compressed gas accumulation chamber from entering the cylindrical compressed gas chamber, and wherein when the piston moves away from the resting position, compressed gas in the compressed gas accumulation chamber can flow through the cylindrical compressed gas chamber and into the compressed gas delivery tube.

3. The gun of claim 2, wherein the compressed gas delivery mechanism further comprises a piston biasing member that biases the piston into the resting position.

4. The gun of claim 3, wherein the piston biasing member is a spring.

5. The gun of claim 3, wherein the compressed gas delivery mechanism further comprises:
- a hammer that is movably mounted on the action housing; and
- a hammer biasing member that biases the hammer in a forward direction, wherein when the hammer is held at a cocked position, the hammer biasing member is compressed, and wherein when the hammer is released from the cocked position, the hammer biasing member causes the hammer to move in the forward direction such that it strikes the piston and causes the piston to move out of its resting position.

6. The gun of claim 5, wherein after the hammer strikes the piston and causes the piston to move out of the resting position, the piston biasing member biases the piston back into the resting position.

7. The gun of claim 6, wherein during the period of time beginning when the hammer strikes the piston and causes the piston to move out of the resting position and ending when the piston biasing member causes the piston to return to the resting position, compressed gas from the compressed gas accumulation chamber is allowed to flow through the cylindrical compressed gas chamber and into the compressed gas delivery tube.

8. The gun of claim 5, further comprising a hammer return spring that biases the hammer in a rearward direction, wherein after the hammer strikes the piston and causes the piston to move out of the resting position, the hammer return spring pushes the hammer rearward such that the piston can return to the resting position.

9. The gun of claim 5, wherein the piston comprises:

a cylindrical main body that is located in the cylindrical compressed gas chamber; and a piston stem that extends rearward from the cylindrical main body.

10. The gun of claim 9, wherein the hammer strikes the piston stem to cause the piston to move away from the resting position.

11. The gun of claim 9, wherein apertures extend through the cylindrical main body of the piston such that compressed gas located on a rearward side of the cylindrical main body can pass through the apertures to a position on a forward side of the cylindrical main body.

12. The gun of claim 11, wherein when the piston moves away from the resting position, compressed gas from the compressed gas accumulation chamber flows through the apertures in the cylindrical main body of the piston to reach the compressed gas delivery tube.

13. The gun of claim 11, wherein the piston further comprises:

a forward o-ring mounted around a forward end of the cylindrical main body, wherein the forward o-ring seals against an interior cylindrical surface of the cylindrical compressed gas chamber; and a rear o-ring mounted around a rear end of the cylindrical main body, wherein the rear o-ring also seals against the interior cylindrical surface of the cylindrical compressed gas chamber, and wherein when the piston is in the resting position, the forward o-ring is located on a forward side of the gas inlet of the cylindrical compressed gas chamber and the rear o-ring is located on a rear side of the gas inlet of the cylindrical compressed gas chamber, and wherein the forward and rear o-rings provide a seal that prevents compressed gas in the compressed gas accumulation chamber from entering the cylindrical compressed gas chamber.

14. The gun of claim 11, wherein the piston further comprises at least one o-ring mounted around a forward end of the cylindrical main body, wherein the at least one o-ring seals against an interior cylindrical surface of the cylindrical compressed gas chamber, wherein a rear seal is provided at a rear end of the cylindrical compressed gas chamber, wherein then the piston is at the resting position, a rear edge of the cylindrical main body of the piston seats against the rear seal, and wherein at least one o-ring and the rear seal prevent compressed gas in the compressed gas accumulation chamber from entering the cylindrical compressed gas chamber.

15. The gun of claim 1, further comprising a nock holding mechanism located adjacent a rear end of the compressed gas delivery tube, wherein the nock holding mechanism is capable of temporarily latching onto a nock of an arrow that has been fitted around the exterior of the compressed gas delivery tube to hold the arrow on the compressed gas delivery tube.

16. The gun of claim 15, wherein the nock holding mechanism comprises a plurality of movably mounted projections that located around an exterior of the rear end of the compressed gas delivery tube and that are biased towards a central axis of the compressed gas delivery tube, wherein the projections can press into an annular groove on the nock of an arrow that has been fitted around the exterior of the compressed gas delivery tube to latch onto the nock of the arrow.

17. The gun of claim 16, wherein the movably mounted projections comprise a balls, and wherein springs bias the balls towards a central axis of the compressed gas delivery tube.

18. The gun of claim 17, further comprising a collar that surrounds the rear end of the compressed gas delivery tube, wherein the balls and springs are mounted in radially extending bores in the collar, and wherein portions of the calls protrude from inner ends of the radially extending bores.

19. The gun of claim 15, wherein the nock holding mechanism comprises:

a collar that surrounds the rear end of the compressed gas delivery tube, wherein a plurality of threaded radially extending bores are formed in the collar; and a plurality of spring nuts, each spring nut including a threaded cylindrical body and a spring loaded ball on an end of the cylindrical body, wherein each spring nut is mounted in a corresponding radial bore of the collar such that the balls of the spring nuts surround the rear end of the compressed gas delivery tube, and such that the balls can press into an annular groove on the nock of an arrow that has been fitted around the exterior of the compressed gas delivery tube to latch onto the nock of the arrow.

20. The gun of claim 19, wherein the collar is mounted on a front end of the action housing, wherein the collar includes a threaded central bore, and wherein a barrel nut that is coupled to the rear end of the compressed gas delivery tube is mounted in the threaded central bore of the collar to couple the compressed gas delivery tube to the action housing.

* * * * *